United States Patent [19]

Meyer et al.

[11] Patent Number: 5,018,234

[45] Date of Patent: May 28, 1991

[54] DRAIN AUGER

[76] Inventors: Fred J. Meyer, 19711 NE. 21 Ct., North Miami Beach, Fla. 33179; Samuel L. Jacks, 15811 Collins Ave. #226, North Miami Beach, Fla. 33160

[21] Appl. No.: 530,196

[22] Filed: May 29, 1990

[51] Int. Cl.[5] ..... B08B 9/02

[52] U.S. Cl. ..... 15/104.33

[58] Field of Search ..... 15/104.33; 254/134.3 FT

[56] References Cited

U.S. PATENT DOCUMENTS 2,470,225 5/1949 Silverman ..... 15/104.33

4,706,321 11/1987 Kaye ..... 15/104.33

*Primary Examiner*—Edward L. Roberts

*Attorney, Agent, or Firm*—Robert M. Schwartz; Edward I. Mates

[57] ABSTRACT

A storage container for a drain cleaning plumbing tool such as a snake or auger having an apertured rear wall is provided with a closure member rotatably mounted to the portion of the rear wall surrounding the aperture. The closure member includes a lever arm and a hook member attached to the radially outer end of the lever arm and a drive rod fixed to said closure member along an axis of rotation. A handle radially offset from said axis of rotation extends axially rearward from said apertured wall. When the hook member engages the handle, a small force sufficient to cause the closure member to rotate cooperates with the lever arm to develop a moment of force sufficient to rotate the storage container and the snake in unison with the rotating closure member developed from the small force insufficient to break the fixed connection between the drive rod and the closure member.

8 Claims, 3 Drawing Sheets

DRAIN AUGER

BACKGROUND OF THE INVENTION

1. Field of the Invention

This invention relates to a container for a drain cleaning plumbing tool that is commonly termed a snake or auger. This invention particularly refers to a container for a plumbing snake which contains a storage chamber and a means for rotating the storage chamber together with a selected length of the snake extending from the storage chamber to rotate within a drain which is clogged. This invention relates to the type of augers that are operated either manually or mechanically.

2. Description of the Prior Art

A drain cleaning plumbing tool which utilizes a motor driving a rotating snake inserted into a clogged drain, pipe or trap to soften and break up debris which clogs the drain, pipe or trap is disclosed in U.S. Pat. No. 3,727,261 issued on Apr. 17, 1973 to Levine. The prior art also contains manually operated auger equipment.

U.S. Pat. No. 4,317,247 to Levine, issued Mar. 2, 1982 discloses apparatus of this type that can be operated either manually or mechanically. The apparatus of this latter patent provides a handle 17, a mechanically rotatable snake storing chamber and a drive rod 24 located along the axis of said chamber and constructed and arranged to be connected adjacent an axis of rotation to a chuck of an electrically operated drill to rotate the snake.

Several features of this latter patent are deficient and require improvement. For example, the housing for the storage chamber of the flexible coiled snake and an extension or passage for positioning a selected length of said snake extending from the storage chamber therethrough for insertion into a clogged trap or drain is made of two parts which must be screwed together. Furthermore, when such apparatus is used mechanically rather than manually, the rotating force for rotating the snake is transmitted directly from the drive rod 24 that is attached to the drill to the rotatable snake storage and receiving apparatus adjacent the axis of rotation. This direct attachment requires a very large initiating force to develop a moment of force sufficiently large to induce rotation of the entire structure of the device and its attached snake. This large initiating force sometimes causes breakage of the direct connection between a drive shaft and the mechanical element of the auger to which the drive shaft is directly attached.

While the mechanically operable version of the latter Levine patented apparatus provides more strength for operating longer snakes required to unclog certain drains than a manually operable version, the fact that the entire mass of the storage device for the rotating snake receives its initial force along or adjacent the axis of rotation makes it necessary to develop an improved drain cleaning plumbing tool that reduces the likelihood of breakage at the juncture between the drive rod of a drill and the auger apparatus and also that makes it unnecessary to screw together separable parts of an auger tool.

SUMMARY OF THE INVENTION

This invention provides novel structure for transmitting a driving force from a drive shaft for a drill to an auger apparatus that includes a storage chamber for a flexible snake, a passage extending axially forward thereof to draw said snake from said storage chamber and means for locking the snake to a wall of said passage. The novel structure comprises a unitary closure member for a central aperture of a rear wall of the storage chamber within which the flexible coiled snake of the auger apparatus is stored. The closure member is constructed and arranged to close the central aperture.

A drive rod extends axially rearward from a thickened hub portion of the unitary closure member along an axis of rotation. A rear end of the drive rod is constructed and arranged for connection to a chuck of a drill and an axially forward portion of the drive rod is constructed and arranged of irregular construction to form a rigid integral structure with the thickened hub portion of the unitary closure member.

A radial arm is provided integral with the closure member. The radial arm extends radially outward from the hub portion to form a lever arm that terminates in a hook member at a radial distance remote from the axis of rotation of the storage chamber. The rear wall of the storage chamber contains a rearwardly extending handle extending axially rearward from the rear wall in radially spaced relation to the axis of the central aperture of the rear wall. A hook member forming part of the radially outward extending lever arm is constructed and arranged to engage the handle. When the drive rod engages a chuck of a drill that is rotated to rotate the lever arm, the latter provides a moment arm that engages the handle at a circularly moving force applying point to drive the unitary closure member, the storage chamber, its associated passage and its connected snake in unison with the drive rod through a driving connection that includes a radially extending moment arm so that the moment of force applied to rotate the apparatus of this invention does not require as large a driving force as is necessary to initially rotate the patented Levine structure from a non-rotating state.

A preferred embodiment of unitary closure member comprises a rear portion slightly larger than the central aperture to enclose an axially rearward wall surface surrounding the central aperture of the rear wall. It also includes a forward portion constructed and arranged to fit through said central aperture to be located within the rear wall of the container. The closure member includes a circumferentially grooved intermediate portion constructed and arranged to make bearing contact with a portion of the rear wall surrounding the central aperture.

Since the closure member is rotatable relative to the rear wall, the hook member may be circumferentially spaced from said handle when the drill starts to rotate the closure member. Under such circumstances, initially the closure member is rotated with a small moment of force relative to the central aperture in the rear wall of the storage chamber until the lever arm rotates into a position where its radially outer hook member engages the axially rearwardly extending handle to cause the lever arm to apply an increased moment of force through said lever arm remote from the axis of rotation to rotate the auger apparatus including its attached snake in unison, so that a lesser force is needed to produce the requisite moment of force to rotate the entire auger apparatus, which reduces the likelihood of breakage of a connection, particularly that between the drive rod and the hub portion. When the hook member and handle are initially disengaged, the closure member rotates relative to the apertured rear wall of the cylindrical storage chamber with an initial small moment of force until the hook at the end of the lever arm engages the handle of the storage chamber. However, even when the hook is initially oriented to engage the eccentrically mounted handle, the inclusion of the lever arm as part of the moment of force for rotating the entire auger apparatus lessens the driving force needed for said moment of force. A smaller driving force is less likely to break the connection between the drive rod and the hub.

The irregular construction of the drill at its axially forward end portion may be a roughened surface or a series of radially extending burrs or fingers to strengthen its connection to the thickened hub portion. The snake storage container and its associated cylindrical passage are blow formed of unitary construction so that it is unnecessary to attach portions thereof together by the use of screws.

The foregoing and other benefits of this invention will become more obvious in the light of a description of a preferred embodiment that follows.

DESCRIPTION OF PREFERRED EMBODIMENTS

Figures 1, 2:
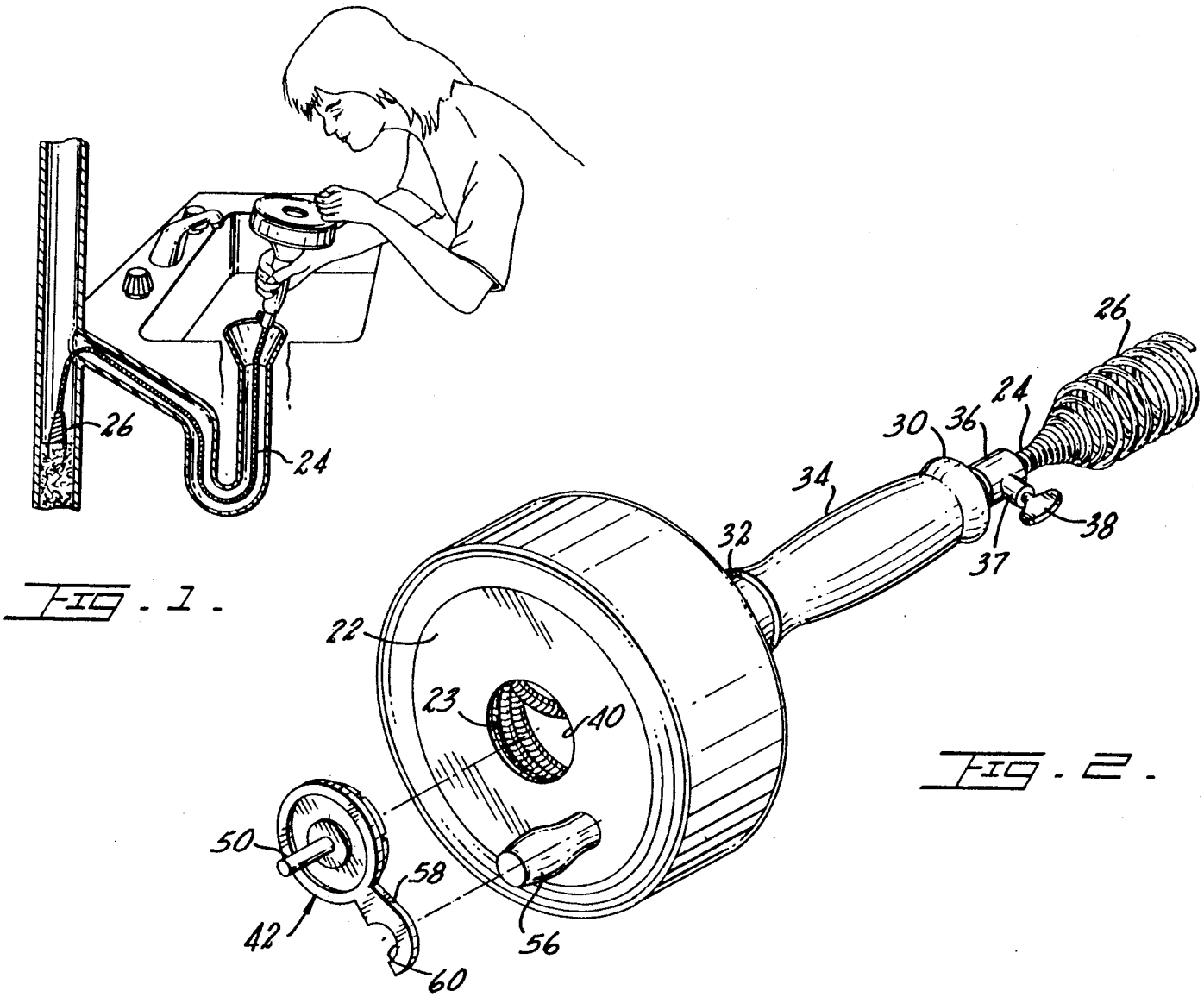
FIG. 1 is a schematic view of a sink with a clogged drain and a manually operated plumber's tool for unclogging said clogged drain including a flexible snake.
FIG. 2 is a perspective exploded view of a container for a plumber's tool similar to that of FIG. 1 modified by the teaching of this invention.

The improved auger of this invention comprises an essentially cylindrical storage container 20 having a front wall 21 and a rear wall 22. A flexible coil snake 23 is stored within the essentially cylindrical storage container. A selective length 24 is unrolled from the snake 23 and terminates in an enlarged front end 26. An elongated essentially cylindrical passage 28 of less cross section than that of the essentially cylindrical storage container 20 is unitary with the container 20 and extends essentially axially forward of the front wall 21. The enlarged front end 26 extends into a drain or pipe that is clogged so that the enlarged front end 26 engages a clogged mass which is hooked or snagged and removed by the enlarged front end 26 of the snake 23 rotating in engagement therewith, as is customary in the art of unclogging drains and the like and is shown in FIG. 1. Elongated passage 28 is provided with an axially forward enlargement 30 and an axially rearward enlargement 32. A rotatable sleeve 34 extends around the outer wall of cylindrical passage 28 to enable an operator to hold the sleeve 34 with one hand as the cylindrical passage 28 rotates in unison with the cylindrical storage container 20 when the device is operated.

The axially front end of the cylindrical passage 28 is apertured radially in alignment within a radially apertured collar 36 extending around said front end. An internally threaded boss 37 is aligned with the radial aperture through the collar and the front end portion of passage 28 to receive a threaded wing nut 38 that is adjustable within the internally threaded boss 37 and the apertured collar 36. A length of flexible coiled snake is pulled out of the elongated passage 28 and the interior end of the threaded portion of the wing nut 38 engages the snake portion 24 within said cylindrical passage 28 to lock the position of the snake within passage 28 and control the length of the forward portion of the snake extending beyond passage 28 that is inserted in a drain to be unclogged.

Rear wall 22 is provided with a central aperture 40 which is closed by a unitary closure member 42. The unitary closure member 42 has a rear portion 43 larger in diameter than central aperture 40 and a front circumferential interrupted ring member 44. The latter has a circumferential surface 45 that is tapered in radius in an axial direction from a radius that is just smaller than the radius of central aperture 40 at its axially forward end and gradually increases to a slightly larger radius at its axial rear end. Interruptions 46 in the front circumferential interrupted ring member 44 make the interrupted ring member flexible to facilitate entry of closure member 42 for assembly within the rear wall 22 with rear portion 43 abutting the portion of rear wall 22 that surrounds central aperture 40. Thus, the unitary closure member 42 is provided with a circumferentially grooved intermediate portion 48 between rear portion 43 and front ring member 44 that makes a bearing contact with the perimeter of the rear wall portion surrounding central aperture 40 of rear wall 42. Closure member 42 has a thickened central hub portion 54 to receive a drive rod 50 to which said thickened hub portion 54 is preferably molded.

Drive rod 50, made of metal preferably, extends axially rearwardly to make engagement with a drill chuck (not shown). The forward end of drive rod 50 is constructed and arranged to improve its fixation to unitary closure member 42. Preferably the forward end of drive rod 50 is either roughened or provided with radially extending spurs and the unitary closure member 42 is molded around the drive rod 50. The central hub portion 54 of the unitary closure member 42 is thickened to receive the forward end 52 of drive rod 50.

Figure 3:
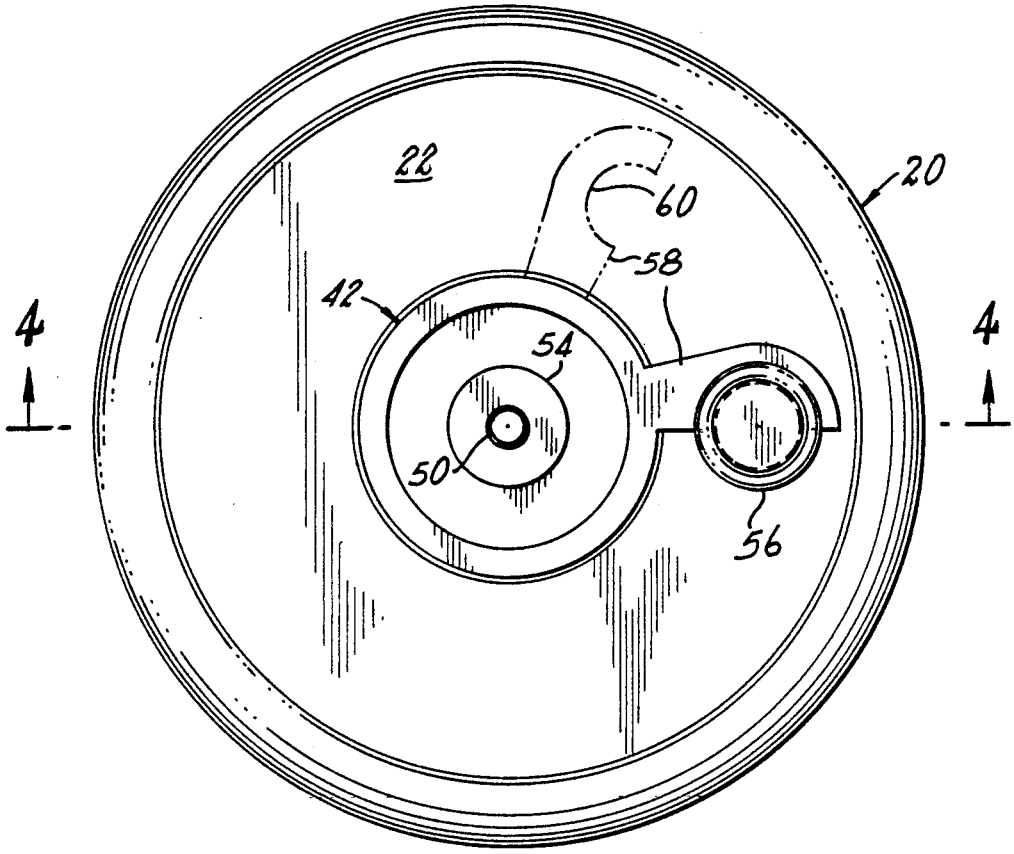
FIG. 3 is a rear view of an apertured rear wall of a container for a plumber's snake, said rear wall of said container being apertured, and a novel closure member for said aperture shown inserted in said rear wall to close said aperture according to this invention, a lever arm for said closure member being shown in phantom disengaged from a handle and in full lines engaging said handle.
Figure 4:
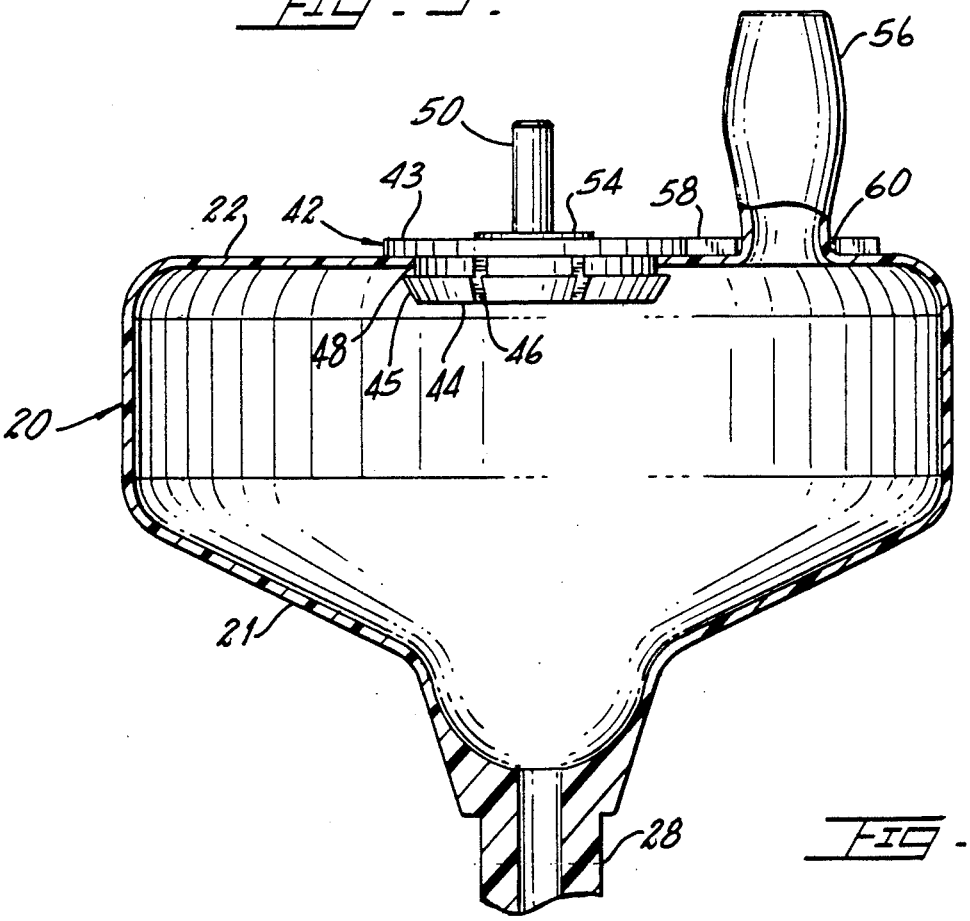
FIG. 4 is a fragmentary sectional view along line 4—4 of FIG. 3, showing an empty container, a unitary closure member and a portion of a cylindrical passage of the FIG. 2 tool.
Figure 5:
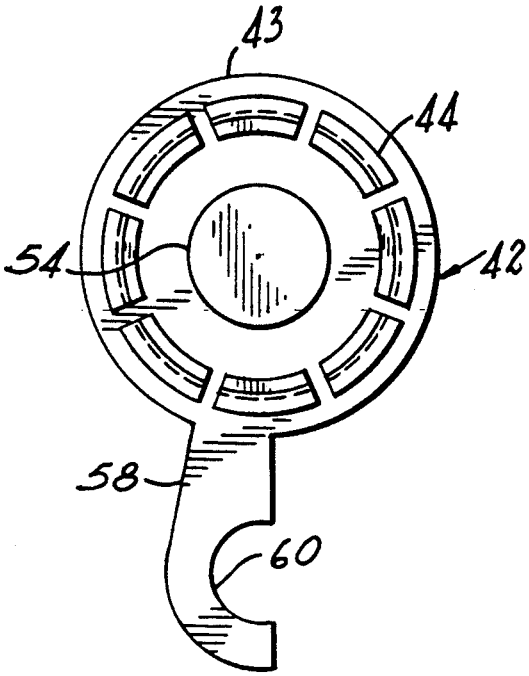
FIG. 5 is a frontal view of the closure member of this invention.
Figure 6:
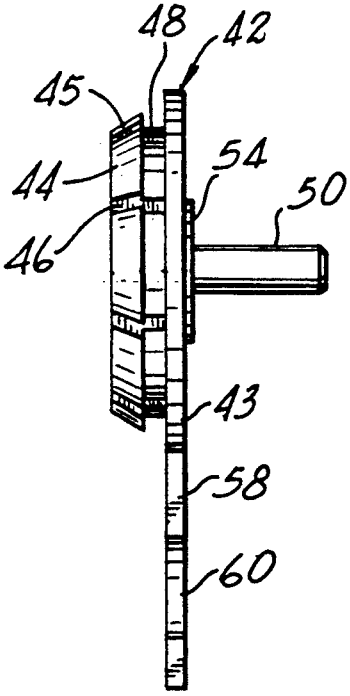
FIG. 6 is a side view of the closure member of FIG. 5.

The single unitary molded closure member 42 also comprises a radially extending lever arm 58 having a hook 60 at its radially outer end. An axially rearward extending handle 56 is mounted on rear wall 22 in a radially remote position with respect to the axis of the central aperture 40 and the lever arm 58 and its hook 60 are constructed and arranged to be able to move between a circumferentially remote position from handle 56, shown in phantom in FIG. 3 and a solid line position in driving engagement with an axially rearwardly extending handle 56.

Figure 7:
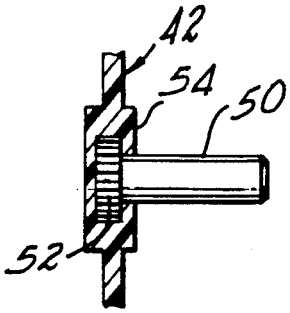
FIG. 7 is a fragmentary cross-section of an enlarged hub portion of said closure member conforming to this invention.

The hook 60 engages the axially rearward extending handle 56 in radially spaced relation from the axis of rotation of drive rod 50 when rod 50 is attached to a drill chuck and the latter is rotated. A small force sufficient to rotate closure member 42 relative to rear wall 22, when acting through lever arm 58, hook 60 and handle 56 provides a moment of force remote from the axis of rotation that rotates the entire auger apparatus including the storage container 20, its elongated cylindrical passage 28 and the snake 23 attached thereto in the extended position for cleaning or unclogging a clogged portion of a drain or a pipe. It is less likely that such a small force will cause the unitary closure member 42 to break at its direct connection with the rotating drive rod 50. The construction and arrangement of the forward end 52 of drive rod 50, of either roughened surface or little burrs extending radially (as shown in FIG. 7) increases the area of engagement between drive rod 50 and closure member 42 to further lessen danger of breakage in this construction compared to that of the prior art as disclosed in the Levine patents previously described.

The essentially cylindrical storage container of relatively large cross-section 20 and its elongated essentially cylindrical extension passage 28 are made of unitary construction using blow mold apparatus of the type that may be ordered from RAO Design Engineering and Management Services, Schiller Park, Ill. This company is also capable of making molds for molding the unitary closure member 42 about drive rod 50.

While the snake is composed of spring steel and the drive rod is also composed of a metal such as steel, the remaining structure of the device of this invention is made of a relatively rigid plastic such as polypropylene and the like. The front circumferential interrupted ring member 44 of the unitary closure member 42 is provided with the interruptions 46 to make the circumferential sectors of interrupted ring member 44 between successive interruptions of an optimum width and thickness so that they can flex relative to the rear wall 22 when the unitary closure member 42 is placed within central aperture 40 without breakage. Thus, unitary closure member 42 makes a bearing contact through circumferentially grooved intermediate portion 48 which is aligned with the wall portion of the rear wall 22 that surrounds central aperture 40. Hence, there is very little resistance to the initial rotation of the unitary closure member 42 until such time as hook 60 at the radially outer end of radially extending lever arm 58 engages axially rearward extending handle 56 to cause the elongated lever arm to provide an increased moment of force that rotates the entire system of the auger tool even when the rotating force transmitted from drive rod 50 directly to hub portion 54 is sufficiently small to make breakage of the driving connection only a remote possibility.

It is understood that this invention may be practiced using the handle 56 for manual operation of the improved auger when the length of extended snake portion 23 is sufficiently small to enable an operator to operate the device manually. FIG. 1 shows such a manual operation.

This specification has met the requirements of the patent statutes for adequate disclosure of this invention by explaining the principle, preferred construction and mode of operation of this invention and by illustrating and describing what is now considered to be its best embodiment. It is understood however, that the invention may be practiced otherwise than as specifically illustrated and described within the scope of the claimed subject matter that follows.

What is claimed is:

1. A container for a drain cleaning plumbing tool having an essentially cylindrical storage chamber of relatively large cross-section for storing a flexible coiled plumber's snake therewithin; an elongated, essentially cylindrical passage of less cross-section than said storage chamber integral with and extending axially forward of said storage chamber for positioning a selected length of said snake extending from said storage chamber therethrough; locking means associated with a wall of said passage to fix a selected length of said snake that extends beyond a forward end of said passage, said storage chamber having a rear wall with a central aperture and a handle extending axially rearwardly of said rear wall in radially spaced relation to said central aperture, characterized by a unitary closure member constructed and arranged to close said central aperture and to make bearing contact with a portion of said rear wall surrounding said central aperture, a drive rod integral with and extending axially rearward from said unitary closure member for connection to a chuck for a drill to form an axis of rotation, said drive rod having an axially forward portion constructed and arranged to form a rigid integral structure with said unitary closure member, a radial arm integral with said closure member extending radially outward from said closure member axially rearward of said rear wall to form a lever arm terminating in a hook member constructed and arranged to engage said handle remote from an axis of rotation when said drive rod engages said chuck of said drill that is rotated, whereby said storage chamber, said passage and said snake are rotated in unison from a drive connection that includes a moment of force through said lever arm, said hook member and said handle remote from said drive rod about said axis of rotation, thereby reducing the likelihood of breakage between said drive rod and said closure member compared to breakage experienced when the entire mass of said storage chamber, said passage and said snake is caused to rotate from driving engagement means adjacent said rotation axis.

2. A container as in claim 1, said closure member comprising a rear portion slightly larger than said central aperture to enclose an axially rearward wall surface surrounding said rear wall central aperture, a forward portion constructed and arranged to fit within said rear wall of said container, said closure member including a circumferentially grooved intermediate portion constructed and arranged to make bearing contact with a portion of said rear wall surrounding said central aperture.

3. A container as in claim 1, wherein said forward portion of said unitary closure member comprises a discontinuous ring member having a plurality of circumferential sections each having an oblique circumferentially extending surface having an axially forward radius less than that of said central aperture gradually increasing to an axially rearward radius at least equal to that of said central aperture so that said unitary closure member can be inserted into and held within said central aperture of said rear wall during its fabrication to align said circumferentially grooved intermediate portion with the portion of said rear wall that surrounds said central aperture of said rear wall.

4. A container as in claim 1, further including an axially forward enlargement and an axially rearward enlargement for said passage and a sleeve constructed and arranged to make rotating bearing contact with a peripheral wall of said passage between said enlargements.

5. A container as in claim 1, wherein said hook member is initially spaced from said handle for application of power to said drill, said closure member and handle being so constructed and arranged that when said drive rod is engaged by said chuck for said drill, said drill initially rotates said closure member through an engagement along said axis of rotation to bring said hook member from a position circumferentially spaced from said handle to a position in engagement with said handle in a first rotation step requiring a small moment of force and upon engagement with said handle causes said lever arm to introduce a moment arm that produces a large moment of force to rotate said unitary closure member in unison with said storage chamber, said passage and said snake in a second rotation step, the use of said two rotation steps reducing the likelihood of breakage between said drive rod and said closure member compared to the likelihood of breakage when the entire mass of said storage chamber, said passage and said snake is caused to rotate in one rotation step with said closure member and said drive rod from driving engagement means adjacent said axis of rotation.

6. A container as in claim 1, wherein said storage chamber, said passage and said closure member including said radially extending lever arm and said hook are composed of a rigid plastic such as polypropylene and the like and said drive rod is composed of metal.

7. A container as in claim 1, wherein said closure member has a thickened central hub engaged by said axially forward portion of said drive rod, which latter portion is of irregular construction.

8. A container as in claim 1, wherein said storage chamber and said passage are blow formed as a unitary structure.

* * * * *